US006015454A

United States Patent [19]

Lacroix et al.

[11] Patent Number: 6,015,454

[45] Date of Patent: Jan. 18, 2000

[54] PROCESS FOR PRINTING TEXTILE FIBRE MATERIALS IN ACCORDANCE WITH THE INK-JET PRINTING PROCESS

[75] Inventors: Roger Lacroix, Village-Neuf; Mickael Mheidle, Sausheim, both of France; Peter Scheibli, Bottmingen, Switzerland

[73] Assignee: Ciba Specialty Chemicals Corporation, Tarrytown, N.Y.

[21] Appl. No.: 09/089,146

[22] Filed: Jun. 2, 1998

[30] Foreign Application Priority Data

Jun. 17, 1997 [CH] Switzerland ..... 1473/97

[51] Int. Cl.[7] ..... C09D 11/02

[52] U.S. Cl. ..... 106/31.47; 106/31.48; 106/31.49; 106/31.52; 106/31.58

[58] Field of Search ..... 106/31.48, 31.47, 106/31.49, 31.52, 31.58

[56] References Cited

U.S. PATENT DOCUMENTS

| | | | |
|---|---|---|---|
| 4,737,190 | 4/1988 | Shimada et al. | 106/31.47 |
| 5,250,121 | 10/1993 | Yamamoto et al. | 106/31.47 |
| 5,383,960 | 1/1995 | Gregory et al. | 106/31.48 |
| 5,542,972 | 8/1996 | Von Der Eltz et al. | 106/31.47 |
| 5,616,694 | 4/1997 | Kenyon et al. | 106/31.48 |
| 5,843,217 | 12/1998 | Ueda et al. | 106/31.48 |

FOREIGN PATENT DOCUMENTS 0534428 3/1993 European Pat. Off. .

OTHER PUBLICATIONS

Structural formula of Reactive Black 5 from Chemical Abstracts registery file on STN, no date available.

Derwent Abstract 85–273488/44, Sep. 1985.

Derwent Abstract 86–249864/38, Sep. 86.

*Primary Examiner*—Helene Klemanski

*Attorney, Agent, or Firm*—Kevin T. Mansfield

[57] ABSTRACT

A process for printing textile fiber materials in accordance with the ink-jet printing process, wherein the fiber materials are printed with an aqueous ink comprising a) at least one reactive dye of formulae (1*a*) to (1*i*) as indicated herein and b) 1,2-propylene glycol or N-methyl-2-pyrrolidone. The process is especially suitable for printing cellulosic fiber materials. The prints obtained have good fastness properties while having a high color yield.

14 Claims, No Drawings

PROCESS FOR PRINTING TEXTILE FIBRE MATERIALS IN ACCORDANCE WITH THE INK-JET PRINTING PROCESS

The present invention relates to processes for printing textile fibre materials using reactive dyes in accordance with the ink-jet printing process (jet and ink-jet processes) and to corresponding printing inks.

Ink-jet printing processes have been used in the textile industry for some years. Such processes make it possible to dispense with the otherwise customary production of a printing screen, so that considerable savings can be made in terms of cost and time. Especially in the case of the production of pattern originals it is possible to respond to a change in requirements within a significantly shorter period of time.

Such ink-jet printing processes should especially have optimum characteristics from the standpoint of application technology. In this connection mention may be made of characteristics such as the viscosity, stability, surface-tension and conductivity of the inks used. Furthermore, higher demands are being made of the quality of the resulting prints, e.g. in respect of colour strength, fibre-dye bond stability and fastness to wetting. Those demands are not met by the known processes in all characteristics, so that there is still a need for new processes for the ink-jet printing of textiles.

The invention relates to a process for printing textile fibre materials in accordance with the ink-jet printing process, wherein the fibre materials are printed with an aqueous ink comprising a) at least one reactive dye of formulae (1a)

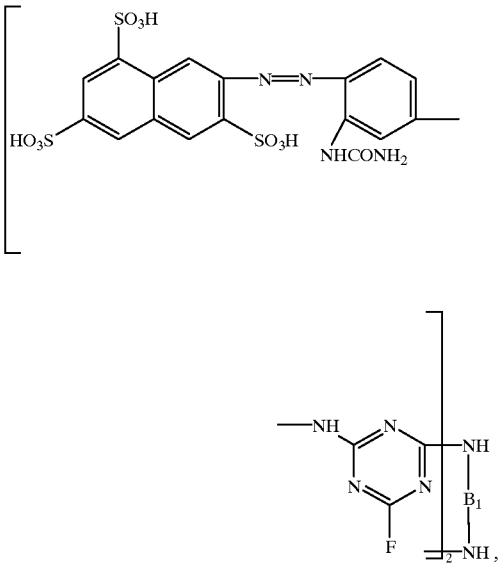

-continued (1b)

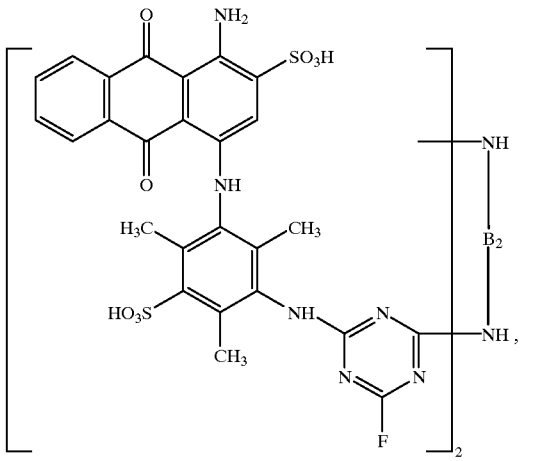

(1c)

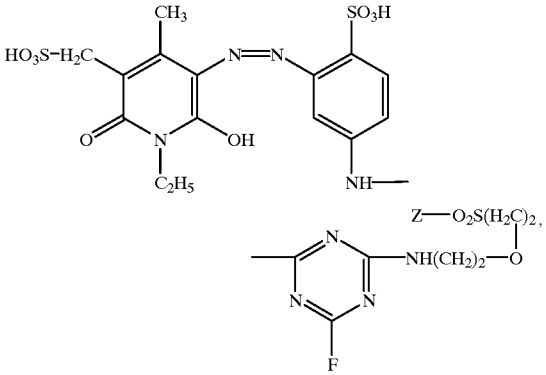

(1d)

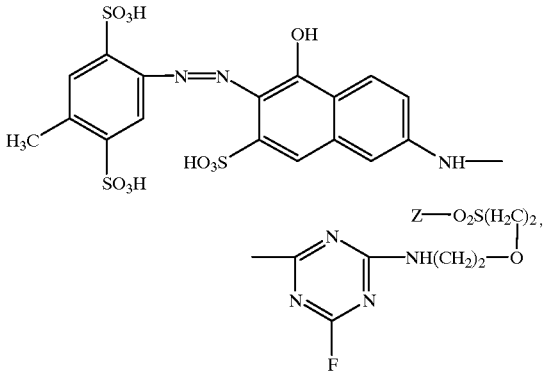

(1e)

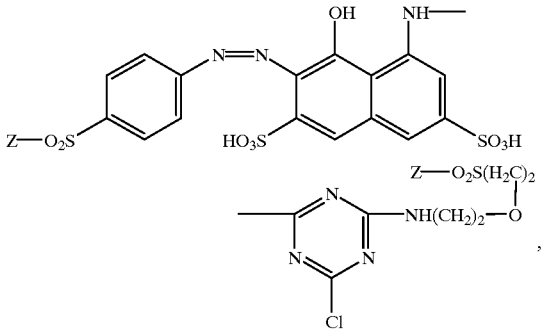

-continued (1f)

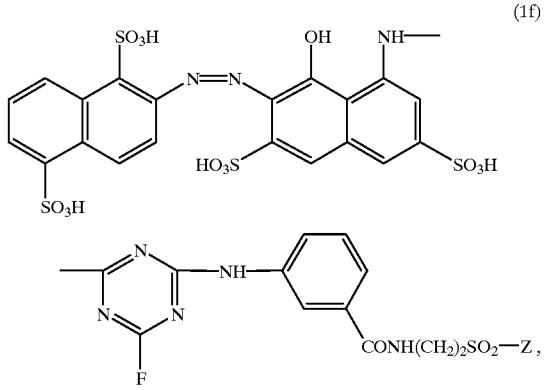

(1g)

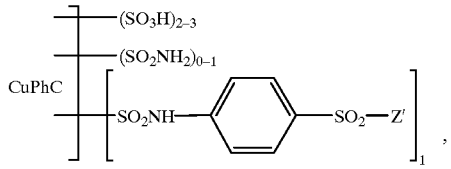

(1h)

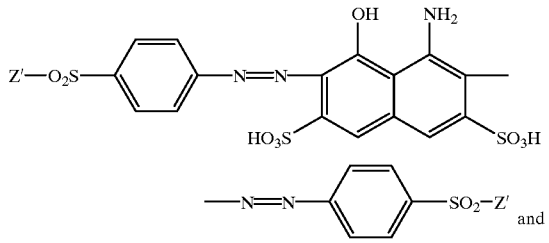

and (1i)

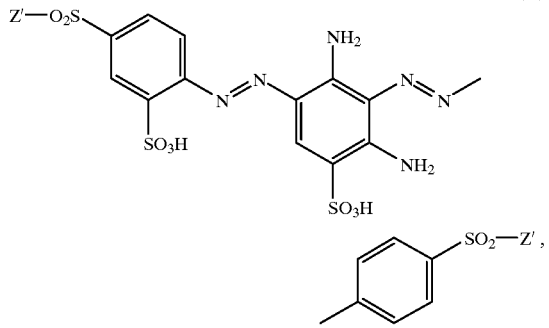

wherein

Z and Z' are each independently of the other vinyl or a radical of the formula —$CH_2$—$CH_2$—$OSO_3H$, $B_1$ and $B_2$ are each a $C_2$–$C_{12}$alkylene radical which may be interrupted by 1, 2 or 3 —O— members and is unsubstituted or substituted by hydroxy, sulfo, sulfato, cyano or by carboxy and CuPhC is a copper phthalocyanine radical, and b) 1,2-propylene glycol or N-methyl-2-pyrrolidone.

$B_1$ and $B_2$ are preferably each a $C_2$–$C_{12}$alkylene radical which may be interrupted by 1 or 2 —O— members and is unsubstituted or substituted by hydroxy.

$B_1$ and $B_2$ are especially each a $C_2$–$C_6$alkylene radical. More especially, $B_1$ is 1,3-propylene and $B_2$ is 1,2-ethylene.

Z is preferably vinyl. The preferred meaning of Z' is a radical of the formula —$CH_2$—$CH_2$—$OSO_3H$.

Preferably, $B_1$ is 1,3-propylene, $B_2$ is 1,2-ethylene, Z is vinyl and Z' is a radical of the formula —$CH_2$—$CH_2$—$OSO_3H$.

Reactive dyes preferred for the process according to the invention are those of formulae (1*a*) to (1*g*), especially of formulae (1*a*) to (1*f*) and more especially those of formulae (1*a*), (1*b*), (1*d*) and (1*f*).

The reactive dyes of formulae (1*a*) to (1*i*) are known or can be obtained analogously to known compounds, e.g. by customary diazotisation, coupling and condensation reactions.

The reactive dyes of formulae (1*a*) to (1*i*) used in the inks should preferably have a low salt content, that is to say they should have a total content of salts of less than 0.5% by weight, based on the weight of the dyes. Reactive dyes that have relatively high salt contents as a result of their preparation and/or as a result of the subsequent addition of diluents can be desalted, for example, by membrane separation procedures, such as ultrafiltration, reverse osmosis or dialysis.

The inks preferably comprise as dyes exclusively those of the above formulae (1*a*) to (1*i*).

The inks preferably have a total content of reactive dyes of the above formulae (1*a*) to (1*i*) of from 5 to 35% by weight, especially from 10 to 35% by weight and more especially from 10 to 20% by weight, based on the total weight of the ink.

The content of N-methyl-2-pyrrolidone or 1,2-propylene glycol in the ink is usually from 5 to 30% by weight, especially from 5 to 20% by weight and more especially from 10 to 20% by weight, based on the total weight of the ink.

Preferably, the inks comprise 1,2-propylene glycol, usually in an amount of from 5 to 30% by weight, especially from 5 to 20% by weight and more especially from 10 to 20% by weight, based on the total weight of the ink.

The inks may also comprise buffer substances, e.g. borax, borates or citrates. Examples that may be mentioned include borax, sodium borate, sodium tetraborate and sodium citrate. They are used especially in amounts of from 0.1 to 3% by weight, preferably from 0.1 to 1% by weight, based on the total weight of the ink, in order to establish a pH value of, for example, from 4 to 9, especially from 4 to 8.

As further additives the inks may comprise, for example, alginates or, especially, water-soluble, non-ionic cellulose ethers. Suitable water-soluble, non-ionic cellulose ethers include, for example, methyl-, ethyl-, hydroxyethyl-, methylhydroxyethyl-, hydroxypropyl- and hydroxypropylmethyl-cellulose. Methylcellulose and especially hydroxyethylcellulose are preferred. Suitable alginates are especially alkali alginates and preferably sodium alginate. The cellulose ethers and the alginates are used in the ink usually in an amount of from 0.01 to 2% by weight, especially from 0.01 to 1% by weight and more especially from 0.01 to 0.5% by weight, based on the total weight of the ink. Both the water-soluble, non-ionic cellulose ethers and the alginates are used as so-called thickeners and enable an ink of a specific viscosity to be obtained.

Preferred for the process according to the invention are those inks which have a viscosity of from 1 to 40 mPa·s, especially from 1 to 20 mPa·s and more especially from 1 to 10 mPa·s.

The inks may also comprise customary additives, such as antifoam agents or especially substances that inhibit the growth of fungi and/or bacteria. Such additives are usually used in amounts of from 0.01 to 1% by weight, based on the total weight of the ink.

The inks can be prepared in customary manner by mixing the individual constituents in the desired amount of water.

The present invention relates also to a process for printing textile fibre materials in accordance with the ink-jet printing process, wherein the fibre materials are printed with an aqueous ink comprising at least one reactive dye of formulae (1*a*), (1*b*), (1*d*) and (1*f*) above. It is also possible to use aqueous inks that comprise at least one reactive dye of formulae (1*a*) to (1*i*) above, especially of formulae (1*a*) to (1*f*), optionally at least one of the additives mentioned above for the inks and no thioglycol and preferably no further additives. The above preferences apply.

The processes for printing textile fibre materials according to the invention can be carried out using ink-jet printers that are known per se and are suitable for textile printing.

In ink-jet printing, individual drops of the ink are sprayed onto a substrate in a controlled manner from a nozzle. For this purpose, predominantly the continuous ink-jet method and the drop-on-demand method are used. In the continuous ink-jet method, the drops are produced continuously and any drops not required for the printing are conveyed to a collecting vessel and recycled. In the drop-on-demand method, however, drops are produced and printed as required; that is to say drops are produced only when required for the printing. The production of the drops can be effected, for example, by means of a piezo-inkjet head or by means of thermal energy (bubble jet). For the process according to the invention, printing in accordance with the continuous ink-jet method or the drop-on-demand method is preferred.

Textile fibre materials that come into consideration are especially hydroxy-group-containing fibre materials. Preference is given to cellulosic fibre materials that consist wholly or partly of cellulose. Examples are natural fibre materials, such as cotton, linen and hemp, and regenerated fibre materials, for example viscose. Special preference is given to viscose and also lyocell and especially cotton. The said fibre materials are preferably in the form of sheet-form textile woven fabrics, knitted fabrics or webs.

According to a preferred embodiment of the present invention, prior to printing the fibre material is subjected to a pretreatment in which the fibre material to be printed is first treated with an aqueous alkaline liquor and the treated fibre material is optionally dried.

The aqueous alkaline liquor comprises at least one of the customary bases used for fixing the reactive dyes in conventional reactive printing processes. The base is used, for example, in an amount of from 10 to 100 g/l of liquor, preferably from 10 to 50 g/l of liquor. Suitable bases are, for example, sodium carbonate, sodium hydroxide, disodium phosphate, trisodium phosphate, sodium acetate, sodium propionate, sodium hydrogen carbonate, aqueous ammonia or sources of alkali, such as sodium chloroacetate or sodium formate. It is preferable to use sodium hydrogen carbonate, sodium carbonate or a mixture of water glass and sodium carbonate. The pH value of the alkaline liquor is generally from 7.5 to 13.5, preferably from 8.5 to 12.5. In addition to the bases, the aqueous alkaline liquor may also comprise further additives, e.g. hydrotropic agents. The hydrotropic agent preferably used is urea, which is used, for example, in an amount of from 25 to 200 g/l of liquor, preferably from 50 to 150 g/l of liquor.

Preferably the fibre material is dried after the above pretreatment.

After printing, the fibre material is advantageously dried, preferably at temperatures of up to 150° C., especially from 80 to 120° C., and then subjected to a heat treatment process in order to complete the print, that is to say to fix the dye.

The heat treatment can be carried out, for example, by means of a hot batch process, a thermosol process or, preferably, by means of a steaming process.

In the case of the steaming process the printed fibre material is subjected, for example, to treatment in a steamer with steam which is optionally superheated, advantageously at a temperature of from 95 to 180° C., more especially in saturated steam.

Subsequently the printed fibre material is generally washed off with water in customary manner in order to remove unfixed dye.

The present invention relates also to aqueous printing inks for the ink-jet printing process, comprising a) from 5 to 35% by weight of at least one reactive dye of the above formulae (1*a*) to (1*i*) and b) from 5 to 30% by weight of N-methyl-2-pyrrolidone or 1,2-propylene glycol.

The printing inks and the reactive dyes of formulae (1*a*) to (1*i*) are subject to the definitions and preferences mentioned hereinabove.

The prints obtainable according to the processes of the invention have good allround properties; for example, they have a high degree of fibre-dye bond stability in both the acidic and the alkaline range, good fastness to light, good fastness to wetting, such as fastness to washing, to water, to seawater, to crossdyeing and to sweat, and good fastness to chlorine, fastness to rubbing, fastness to hot pressing and fastness to pleating, as well as sharp outlines and a high colour strength. The printing inks used are distinguished by good stability and good viscosity characteristics.

The following Examples serve to illustrate the invention. The temperatures are given in degrees Celsius, parts are parts by weight and percentages relate to percent by weight, unless otherwise indicated. Parts by weight relate to parts by volume in a ratio of kilograms to litres.

EXAMPLE 1 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink having a viscosity of 2 mPa·s, containing 15% by weight of the reactive dye of formula (101)

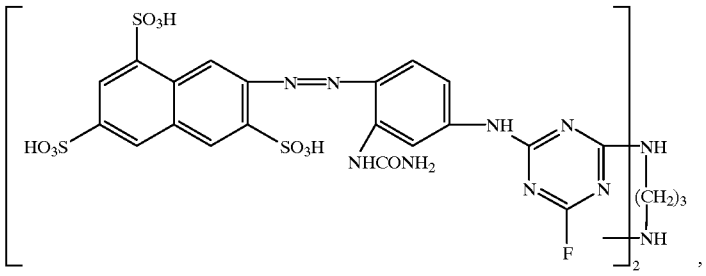

15% by weight of 1,2-propylene glycol, 0.5% by weight of borax and 69.5% by weight of water, using a drop-on-demand ink-jet head (bubble jet). The print is dried completely and fixed for 4 minutes at 102° C. in saturated steam, cold-rinsed, washed off at boiling, rinsed again and dried. A yellow print having very good fastness to washing is obtained.

EXAMPLE 2 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing 15% by weight of the reactive dye of formula (102)

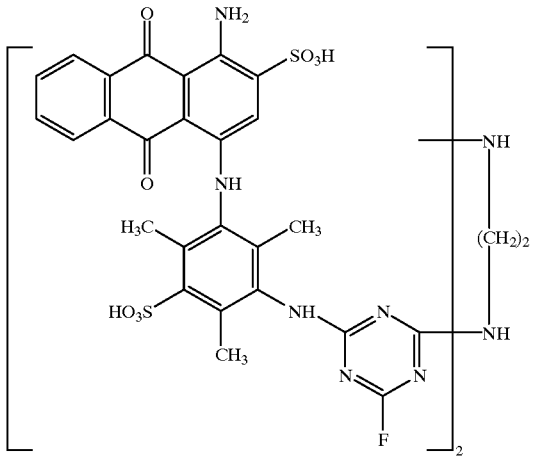

15% by weight of 1,2-propylene glycol, 0.5% by weight of borax and 69.5% by weight of water, using a drop-on-demand ink-jet head (bubble jet). The print is dried completely and fixed for 4 minutes at 102° C. in saturated steam, cold-rinsed, washed off at boiling, rinsed again and dried. A blue print having very good fastness to washing is obtained.

EXAMPLE 3 a) Causticized woven viscose fabric is pad-dyed with a liquor comprising 30 g/l of sodium carbonate and 100 g/l of urea (liquor pick-up 70%) and dried.

b) The causticized woven viscose fabric pretreated in accordance with Step a) is printed with an aqueous ink having a viscosity of 2 mPa·s, containing 15% by weight of the reactive dye of formula (103)

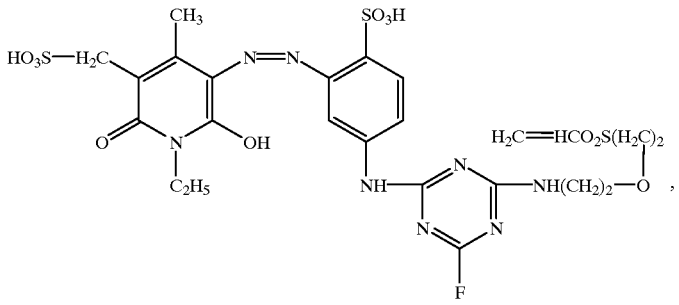

15% by weight of 1,2-propylene glycol,
0.5% by weight of borax and
69.5% by weight of water, using a drop-on-demand ink-jet head (bubble jet). The print is dried completely and fixed for 4 minutes at 102° C. in saturated steam, cold-rinsed, washed off at boiling, rinsed again and dried. A yellow print having very good fastness to washing is obtained.

EXAMPLE 4 a) Causticized woven viscose fabric is pad-dyed with a liquor comprising 30 g/l of sodium carbonate and 150 g/l of urea (liquor pick-up 70%) and dried.

b) The causticized woven viscose fabric pretreated in accordance with Step a) is printed with an aqueous ink having a viscosity of 2 mPa·s, containing
15% by weight of the reactive dye of formula 15% by weight of 1,2-propylene glycol,
0.5% by weight of borax and
69.5% by weight of water, using a drop-on-demand ink-jet head (bubble jet). The print is dried completely and fixed for 4 minutes at 102° C. in saturated steam, cold-rinsed, washed off at boiling, rinsed again and dried. An orange print having very good fastness to washing is obtained.

EXAMPLE 5 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink having a viscosity of 2 mPa·s, containing
15% by weight of the reactive dye of formula (104)

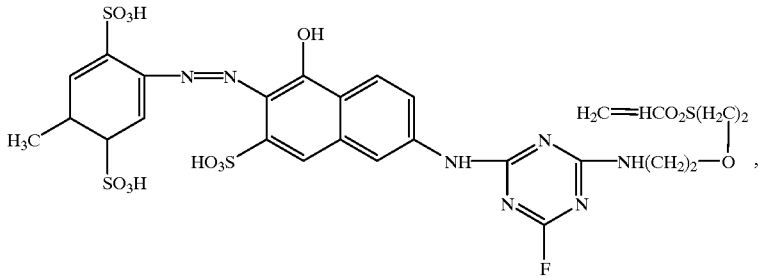

(105)

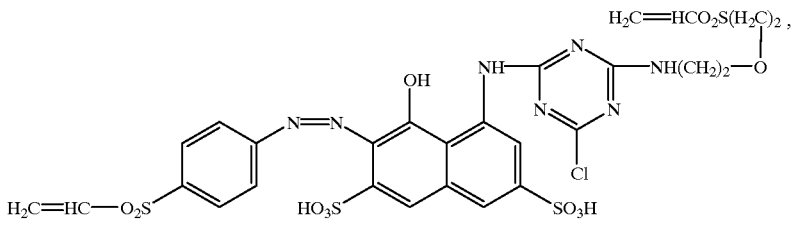

15% by weight of 1,2-propylene glycol and
70% by weight of water, using a drop-on-demand ink-jet head (bubble jet). The print is dried completely and fixed for 4 minutes at 102° C. in saturated steam, cold-rinsed, washed off at boiling, rinsed again and dried. A red print having very good fastness to washing is obtained.

EXAMPLE 6 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing 15% by weight of the reactive dye of formula (106)

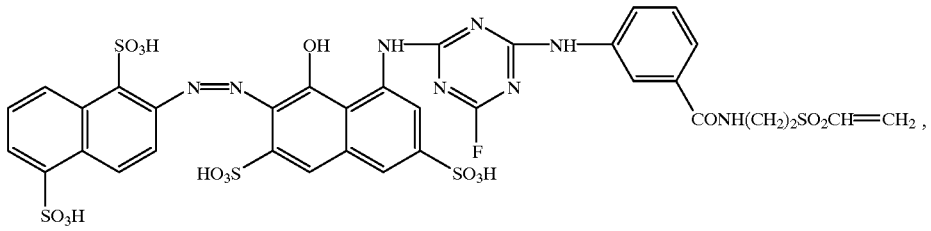

15% by weight of 1,2-propylene glycol,
0.5% by weight of borax and
69.5% by weight of water, using a drop-on-demand ink-jet head (bubble jet). The print is dried completely and fixed for 4 minutes at 102° C. in saturated steam, cold-rinsed, washed off at boiling, rinsed again and dried. A red print having very good fastness to washing is obtained.

EXAMPLE 7 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing 15% by weight of the reactive dye of formula (107)

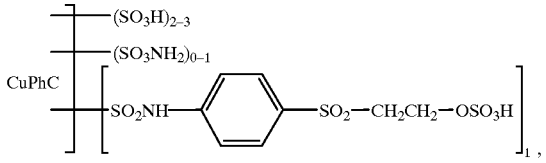

15% by weight of 1,2-propylene glycol,
0.5% by weight of sodium citrate and
69.5% by weight of water, using a drop-on-demand ink-jet head (bubble jet). The print is dried completely and fixed for 4 minutes at 102° C. in saturated steam, cold-rinsed, washed off at boiling, rinsed again and dried. A turquoise-coloured print having very good fastness to washing is obtained.

EXAMPLE 8 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing 15% by weight of the reactive dye of formula (108)

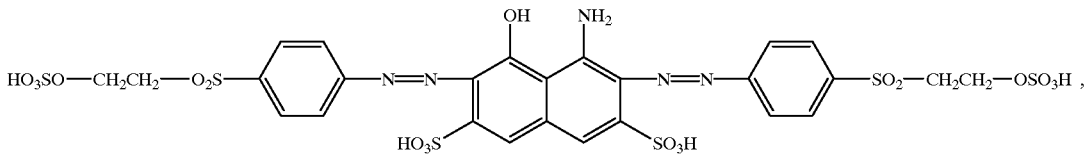

15% by weight of 1,2-propylene glycol and
70% by weight of water, using a drop-on-demand ink-jet head (bubble jet). The print is dried completely and fixed for 4 minutes at 102° C. in saturated steam, cold-rinsed, washed off at boiling, rinsed again and dried. A blue print having very good fastness to washing is obtained.

EXAMPLE 9 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink having a viscosity of 2 mPa·s, containing
15% by weight of the reactive dye of formula (101),
0.5% by weight of borax and
84.5% by weight of water, using a continuous flow ink-jet head. The print is dried completely and fixed for 4 minutes at 102° C. in saturated steam, cold-rinsed, washed off at boiling, rinsed again and dried. A yellow print having very good fastness to washing is obtained.

EXAMPLE 10 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing
15% by weight of the reactive dye of formula (102),
0.5% by weight of borax and
84.5% by weight of water, using a continuous flow ink-jet head. The print is dried completely and fixed for 4 minutes at 102° C. in saturated steam, cold-rinsed, washed off at boiling, rinsed again and dried. A blue print having very good fastness to washing is obtained.

EXAMPLE 11 a) Causticized woven viscose fabric is pad-dyed with a liquor comprising 30 g/l of sodium carbonate and 150 g/l of urea (liquor pick-up 70%) and dried.

b) The causticized woven viscose fabric pretreated in accordance with Step a) is printed with an aqueous ink having a viscosity of 2 mPa·s, containing
15% by weight of the reactive dye of formula (104),
0.5% by weight of borax and
84.5% by weight of water, using a continuous flow ink-jet head. The print is dried completely and fixed for 4 minutes at 102° C. in saturated steam, cold-rinsed, washed off at boiling, rinsed again and dried. An orange print having very good fastness to washing is obtained.

EXAMPLE 12 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink having a viscosity of 2 mPa·s, containing
15% by weight of the reactive dye of formula (106),
0.5% by weight of borax and
84.5% by weight of water, using a continuous flow ink-jet head. The print is dried completely and fixed for 4 minutes at 102° C. in saturated steam, cold-rinsed, washed off at boiling, rinsed again and dried. A red print having very good fastness to washing is obtained.

EXAMPLES 13 to 20

By following a procedure as indicated in any one of Examples 1 to 8, but using 15% by weight of N-methyl-2-pyrrolidone instead of 15% by weight of 1,2-propylene glycol, analogous prints having good fastness to washing are obtained.

What is claimed is:

1. A process for printing textile fibre materials in accordance with the ink-jet printing process, wherein the fibre materials are printed with an aqueous ink comprising a) at least one reactive dye of formulae (1a)

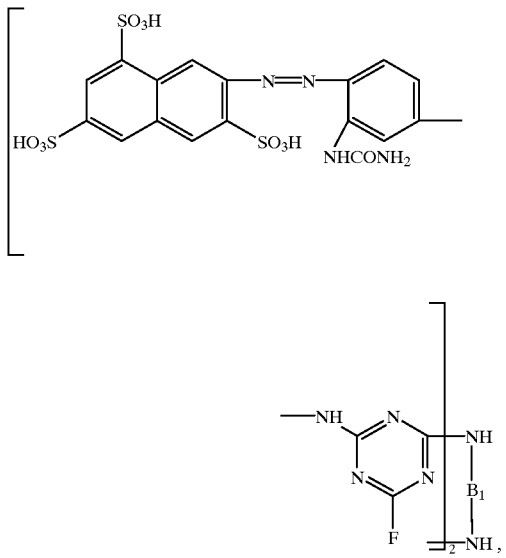

-continued (1b)

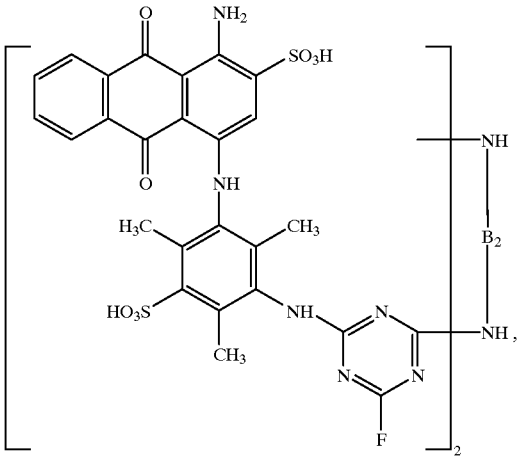

(1c)

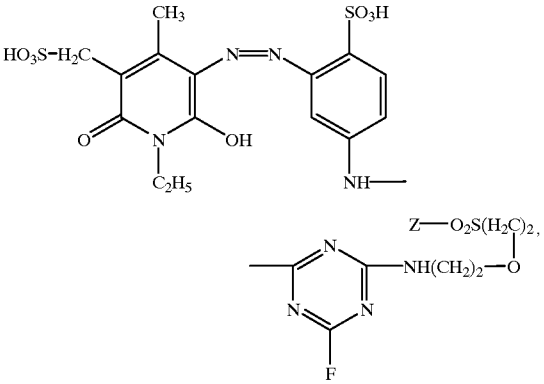

(1d)

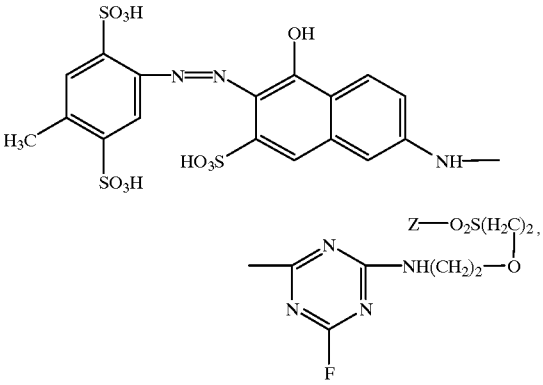

(1e)

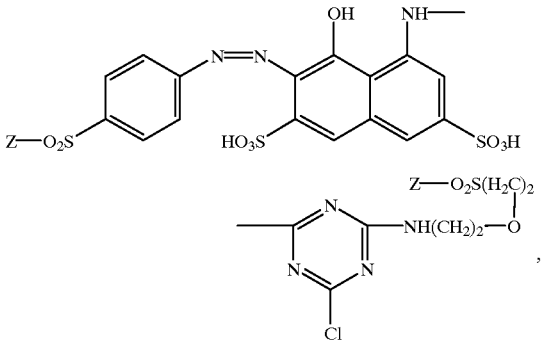

-continued (1f)

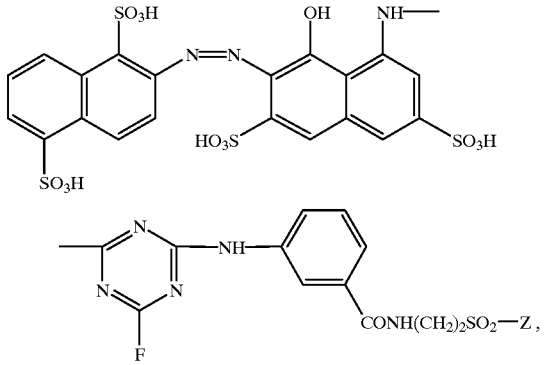

(1g)

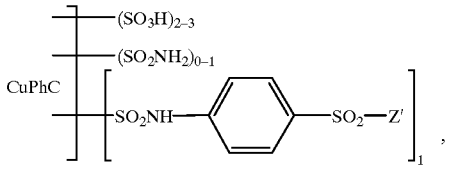

(1h)

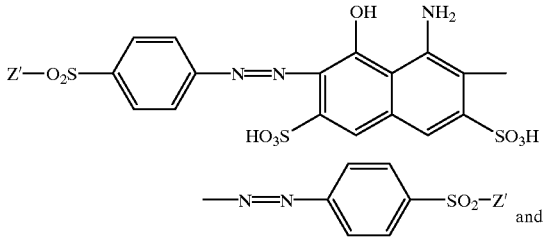

and (1i)

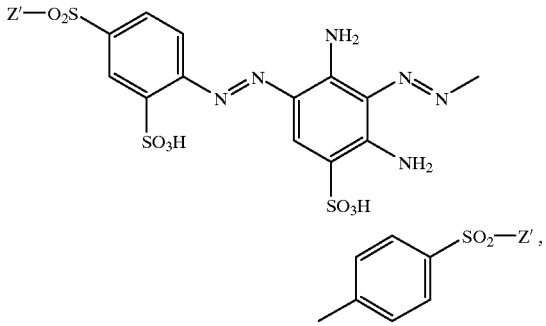

wherein

Z and Z' are each independently of the other vinyl or a radical of the formula $—CH_2—CH_2OSO_3H$, $B_1$ and $B_2$ are each a $C_2$–$C_{12}$alkylene radical which may be interrupted by 1, 2 or 3 —O— members and is unsubstituted or substituted by hydroxy, sulfo, sulfato, oyano or by carboxy and CuPhC is a copper phthalocyanine radical, and b) 1,2-propylene glycol or N-methyl-2-pyrrolidone with the proviso that said ink does not contain any substantial amount of a compound of the formula $S(CH_2CH_2OH)_2$.

2. A process according to claim 1, wherein Z is vinyl.

3. A process according to claim 1, wherein Z' is a radical of the formula $—CH_2—CH_2—OSO_3H$.

4. A process according to claim 1, wherein $B_1$ and $B_2$ are each a $C_2$–$C_6$-alkylene radical.

5. A process according to claim 1, wherein $B_1$ is 1,3-propylene, $B_2$ is 1,2-ethylene, Z is vinyl and Z' is a radical of the formula $—CH_2—CH_2—OSO_3H$.

6. A process according to claim 1, wherein said ink has a total content of reactive dyes of formulae (1*a*) to (1*i*) of from 5 to 35% by weight.

7. A process according to claim 1, wherein said ink comprises from 5 to 30% by weight of N-methyl-2-pyrrolidone or 1,2-propylene glycol.

8. A process according to claim 1, wherein said ink comprises from 5 to 30% by weight of 1,2-propylene glycol.

9. A process according to claim 1, wherein said ink having a viscosity of from 1 to 40 mPa·s.

10. A process according to claim 1, wherein an ink further comprises a buffer substance.

11. A process according to claim 1, wherein said fibre materials are cellulosic fibre material.

12. A process for printing textile fibre materials in accordance with the ink-jet printing process, wherein the fibre materials are printed with an aqueous ink comprising at least one reactive dye of formulae (1*a*), (1*b*), (1*d*) and (1*f*) according to claim 1.

13. An aqueous printing ink for the ink-jet printing process, comprising a) from 5 to 35% by weight of at least one reactive dye of formulae (1*a*) to (1*i*) according to claim 1 and b) from 5 to 30% by weight of N-methyl-2-pyrrolidone or 1,2-propylene glycol with the proviso that said ink does not contain any substantial amount of a compound of the formula $S(CH_2CH_2OH)_2$.

14. An aqueous printing ink according to claim 13, comprising from 5 to 30% by weight of 1,2-propylene glycol.

* * * * *